US008579023B1

(12) United States Patent
Nish et al.

(10) Patent No.: US 8,579,023 B1
(45) Date of Patent: Nov. 12, 2013

(54) COMPOSITE DOWNHOLE TOOL WITH RATCHET LOCKING MECHANISM

(75) Inventors: Randall William Nish, Provo, UT (US); Jason Jon Vogel, Sandy, UT (US)

(73) Assignee: Exelis Inc., McLean, VA (US)

( * ) Notice: Subject to any disclaimer, the term of this patent is extended or adjusted under 35 U.S.C. 154(b) by 415 days.

(21) Appl. No.: 12/916,095

(22) Filed: Oct. 29, 2010

(51) Int. Cl.
*E21B 33/12* (2006.01)

(52) U.S. Cl.
USPC ..... 166/134; 166/118

(58) Field of Classification Search
USPC ..... 166/182, 118, 134
See application file for complete search history.

(56) References Cited

U.S. PATENT DOCUMENTS

| | | | | |
|---|---|---|---|---|
| 1,684,266 | A | | 9/1928 | Fisher et al. |
| 2,043,225 | A | | 6/1936 | Armentrout et al. |
| 2,160,804 | A | | 5/1939 | Hall et al. |
| 2,205,119 | A | | 6/1940 | Hall et al. |
| 2,230,712 | A | | 2/1941 | Bendeler et al. |
| 2,249,172 | A | | 7/1941 | Quintrell |
| 2,338,326 | A | | 1/1944 | Green |
| 2,577,068 | A | | 12/1951 | Baker |
| 2,589,506 | A | | 3/1952 | Morrisett |
| 2,672,199 | A | | 3/1954 | McKenna |
| 2,725,941 | A | | 12/1955 | Henshaw |
| 2,785,758 | A | | 3/1957 | Baker |
| 3,021,902 | A | | 2/1962 | Keithahn |
| 3,136,365 | A | | 6/1964 | Carter et al. |
| 3,148,731 | A | | 9/1964 | Holden |
| 3,163,225 | A | | 12/1964 | Perkins |
| 3,211,232 | A | | 10/1965 | Grimmer |
| 3,298,440 | A | | 1/1967 | Current |
| 3,306,366 | A | | 2/1967 | Muse |
| 3,314,480 | A | | 4/1967 | Scott |
| 3,420,304 | A | | 1/1969 | Kilgore |
| 3,497,003 | A | | 2/1970 | Berryman et al. |
| 3,506,067 | A | | 4/1970 | Lebourg |
| 3,517,742 | A | | 6/1970 | Williams |
| 3,570,595 | A | * | 3/1971 | Berryman ..... 166/128 |
| 3,831,677 | A | | 8/1974 | Mullins |
| 3,976,133 | A | | 8/1976 | Allen |
| 4,099,563 | A | | 7/1978 | Hutchison et al. |
| 4,151,875 | A | | 5/1979 | Sullaway |
| 4,285,398 | A | | 8/1981 | Zandmer et al. |
| 4,289,200 | A | | 9/1981 | Fisher, Jr. |
| 4,312,406 | A | | 1/1982 | McLaurin et al. |
| 4,359,090 | A | | 11/1982 | Luke |
| 4,397,351 | A | | 8/1983 | Harris |
| 4,432,418 | A | | 2/1984 | Mayland |

(Continued)

OTHER PUBLICATIONS

U.S. Appl. No. 13/362,185, filed Jan. 31, 2012; Randall W. Nish; office action issued May 2, 2012.

(Continued)

*Primary Examiner* — David Andrews
*Assistant Examiner* — Kipp Wallace
(74) *Attorney, Agent, or Firm* — Thorpe North & Western LLP

(57) ABSTRACT

A downhole tool or plug includes a mandrel with an element, a slip ring, and a cone pressable between an upper push sleeve assembly and a lower anvil. The upper push sleeve assembly including a lock ring having one or more interior teeth on an interior of the lock ring. A mandrel sleeve is at least partially received within a recess in the mandrel and affixed with respect to the mandrel, and has one or more exterior teeth on an exterior of the mandrel sleeve.

15 Claims, 7 Drawing Sheets

(56) References Cited

U.S. PATENT DOCUMENTS 4,488,595 A 12/1984 Akkerman
4,524,825 A 6/1985 Fore
4,532,989 A 8/1985 Barker
4,542,788 A 9/1985 Semar
4,553,596 A 11/1985 Graham et al.
4,664,188 A 5/1987 Zunkel et al.
4,665,977 A * 5/1987 Mullins ..... 166/134
4,708,202 A 11/1987 Sukup et al.
4,730,835 A 3/1988 Wilcox et al.
4,739,829 A 4/1988 Brunner
4,745,972 A 5/1988 Bell et al.
4,784,226 A 11/1988 Wyatt
4,813,481 A 3/1989 Sproul et al.
4,834,184 A 5/1989 Streich et al.
4,858,687 A 8/1989 Watson et al.
4,926,938 A 5/1990 Lindsey, Jr.
4,984,636 A * 1/1991 Bailey et al. ..... 166/277
5,086,839 A 2/1992 Setterberg, Jr. et al.
5,095,978 A 3/1992 Akkerman et al.
5,131,468 A 7/1992 Lane et al.
5,188,182 A 2/1993 Echols, III et al.
5,224,540 A 7/1993 Streich et al.
5,253,709 A 10/1993 Kendrick et al.
5,271,468 A 12/1993 Streich et al.
5,333,684 A 8/1994 Walter et al.
5,340,626 A 8/1994 Head
5,390,737 A 2/1995 Jacobi et al.
5,392,856 A 2/1995 Broussard, Jr. et al.
5,404,956 A 4/1995 Bohlen et al.
5,413,172 A 5/1995 Laurel
5,422,183 A 6/1995 Sinclair et al.
5,441,111 A 8/1995 Whiteford
5,479,986 A 1/1996 Gano et al.
5,540,279 A 7/1996 Branch et al.
5,542,473 A 8/1996 Pringle et al.
5,553,667 A 9/1996 Budde et al.
5,597,784 A 1/1997 Sinclair et al.
5,607,017 A 3/1997 Owens et al.
5,613,560 A 3/1997 Jelinski et al.
5,678,635 A 10/1997 Dunlap et al.
5,701,959 A 12/1997 Hushbeck et al.
5,749,419 A 5/1998 Coronado et al.
5,765,641 A 6/1998 Shy et al.
5,787,979 A 8/1998 Giroux et al.
5,813,457 A 9/1998 Giroux et al.
5,819,846 A 10/1998 Bolt, Jr.
5,837,656 A 11/1998 Sinclair et al.
5,839,515 A 11/1998 Yuan et al.
5,904,207 A 5/1999 Rubbo et al.
5,924,696 A 7/1999 Frazier
5,941,309 A 8/1999 Appleton
5,984,007 A 11/1999 Yuan et al.
5,990,051 A 11/1999 Ischy et al.
6,009,944 A 1/2000 Gudmestad
6,026,903 A 2/2000 Shy et al.
6,056,053 A 5/2000 Giroux et al.
6,076,600 A 6/2000 Vick, Jr. et al.
6,082,451 A 7/2000 Giroux et al.
6,131,663 A 10/2000 Henley et al.
6,145,593 A 11/2000 Hennig
6,167,957 B1 1/2001 Frazier
6,167,963 B1 1/2001 McMahan et al.
6,189,618 B1 2/2001 Beeman et al.
6,220,349 B1 4/2001 Vargus et al.
6,220,350 B1 4/2001 Brothers et al.
6,244,642 B1 6/2001 Serafin et al.
6,279,656 B1 8/2001 Sinclair et al.
6,318,461 B1 11/2001 Carisella
6,318,729 B1 11/2001 Pitts, Jr. et al.
6,354,372 B1 3/2002 Carisella et al.
6,394,180 B1 5/2002 Berscheidt et al.
6,412,388 B1 7/2002 Frazier
6,431,274 B1 8/2002 Nowlin et al.
6,481,496 B1 11/2002 Jackson et al.
6,491,108 B1 12/2002 Slup et al.
6,491,116 B2 12/2002 Berscheidt et al.
6,540,033 B1 4/2003 Sullivan et al.
6,578,633 B2 6/2003 Slup et al.
6,581,681 B1 6/2003 Zimmerman et al.
6,598,672 B2 7/2003 Bell et al.
6,598,679 B2 7/2003 Robertson
6,599,863 B1 7/2003 Palmer et al.
6,651,738 B1 11/2003 Solfronk et al.
6,651,743 B2 11/2003 Szarka
6,655,459 B2 12/2003 Mackay
6,666,275 B2 12/2003 Neal et al.
6,695,050 B2 2/2004 Winslow et al.
6,695,051 B2 2/2004 Smith et al.
6,708,768 B2 3/2004 Slup et al.
6,708,770 B2 3/2004 Slup et al.
6,712,153 B2 3/2004 Turley et al.
6,732,822 B2 5/2004 Slack et al.
6,752,209 B2 6/2004 Mondelli et al.
6,769,491 B2 8/2004 Zimmerman et al.
6,793,022 B2 9/2004 Vick et al.
6,796,376 B2 9/2004 Frazier
6,799,638 B2 10/2004 Butterfield, Jr.
6,827,150 B2 12/2004 Luke
6,976,534 B2 12/2005 Sutton et al.
6,986,390 B2 1/2006 Doane et al.
7,017,672 B2 3/2006 Owen, Sr.
7,036,602 B2 5/2006 Turley et al.
7,044,230 B2 5/2006 Starr et al.
7,049,272 B2 5/2006 Sinclair et al.
7,093,664 B2 8/2006 Todd et al.
7,124,831 B2 10/2006 Turley et al.
7,163,066 B2 1/2007 Lehr
7,168,494 B2 1/2007 Starr et al.
7,210,533 B2 5/2007 Starr et a
7,255,178 B2 8/2007 Slup et al.
7,258,165 B1 8/2007 Williams
7,273,099 B2 9/2007 East, Jr. et al.
7,287,596 B2 10/2007 Frazier et al.
7,322,413 B2 1/2008 Rogers et al.
7,337,852 B2 3/2008 Manke et al.
7,350,582 B2 4/2008 McKeachnie et al.
7,353,879 B2 4/2008 Todd et al.
7,373,973 B2 5/2008 Smith et al.
7,380,600 B2 6/2008 Willberg et al.
7,395,856 B2 7/2008 Murray
7,452,161 B2 11/2008 Freyer et al.
7,455,118 B2 * 11/2008 Roberts et al. ..... 166/387
7,461,699 B2 12/2008 Richard et al.
7,464,764 B2 12/2008 Xu
7,475,736 B2 1/2009 Lehr et al.
7,510,018 B2 3/2009 Williamson et al.
7,735,549 B1 6/2010 Nish et al.
7,743,836 B2 6/2010 Cook et al.
7,789,135 B2 9/2010 Turley et al.
7,900,696 B1 3/2011 Nish et al.
7,980,300 B2 7/2011 Roberts et al.
8,403,036 B2 3/2013 Neer et al.
2002/0070503 A1 6/2002 Zimmerman et al.
2002/0162662 A1 11/2002 Passamaneck et al.
2003/0155112 A1 8/2003 Tiernan et al.
2003/0188862 A1 10/2003 Streich et al.
2003/0226660 A1 12/2003 Winslow et al.
2004/0003928 A1 1/2004 Frazier
2004/0036225 A1 2/2004 Ritter et al.
2004/0045723 A1 3/2004 Slup et al.
2004/0177952 A1 9/2004 Turley et al.
2005/0077053 A1 * 4/2005 Walker et al. ..... 166/387
2005/0161224 A1 7/2005 Starr et al.
2005/0189103 A1 9/2005 Roberts et al.
2005/0205264 A1 9/2005 Starr et al.
2006/0124307 A1 6/2006 Turley et al.
2006/0131031 A1 6/2006 McKeachnie et al.
2006/0278405 A1 12/2006 Turley et al.
2007/0039160 A1 2/2007 Turley et al.
2007/0074873 A1 4/2007 McKeachnie et al.
2007/0102165 A1 5/2007 Slup et al.
2007/0119600 A1 5/2007 Slup et al.
2007/0284097 A1 12/2007 Swor et al.
2007/0284114 A1 12/2007 Swor et al.

(56) References Cited

U.S. PATENT DOCUMENTS

| | | | | |
|---|---|---|---|---|
| 2008/0047717 | A1 | 2/2008 | Frazier et al. | |
| 2008/0060821 | A1 | 3/2008 | Smith et al. | |
| 2008/0073074 | A1 | 3/2008 | Frazier | |
| 2008/0073081 | A1 | 3/2008 | Frazier et al. | |
| 2008/0073086 | A1 | 3/2008 | Cook et al. | |
| 2008/0202764 | A1 | 8/2008 | Clayton et al. | |
| 2008/0257549 | A1 | 10/2008 | Swor et al. | |
| 2009/0000792 | A1* | 1/2009 | Turley et al. | 166/376 |
| 2009/0038790 | A1 | 2/2009 | Barlow | |
| 2009/0044957 | A1 | 2/2009 | Clayton et al. | |
| 2009/0065194 | A1 | 3/2009 | Frazier | |
| 2009/0065216 | A1 | 3/2009 | Frazier | |
| 2009/0078647 | A1 | 3/2009 | Frazier et al. | |
| 2009/0139720 | A1 | 6/2009 | Frazier | |
| 2009/0159274 | A1 | 6/2009 | Frazier | |
| 2009/0178808 | A1 | 7/2009 | Williamson et al. | |
| 2010/0024703 | A1 | 2/2010 | Zampiello et al. | |
| 2010/0155050 | A1 | 6/2010 | Frazier | |
| 2010/0276159 | A1 | 11/2010 | Mailand et al. | |
| 2010/0282004 | A1 | 11/2010 | Nance et al. | |
| 2011/0079383 | A1 | 4/2011 | Porter et al. | |

OTHER PUBLICATIONS

U.S. Appl. No. 12/549,652, filed Aug. 28, 2009; Jason Jon Vogel; office action issued Apr. 18, 2012.

U.S. Appl. No. 12/549,652, filed Aug. 28, 2009; Jason Jon Vogel; notice of allowance issued May 23, 2012.

U.S. Appl. No. 13/362,185, filed Jan. 31, 2012; Randall W. Nish; office action dated Aug. 29, 2012.

U.S. Appl. No. 12/353,655, filed Jan. 14, 2009; Randall Nish; Notice of Allowance issued Nov. 2, 2011.

U.S. Appl. No. 12/549,652, filed Aug. 28, 2009; Jason Vogel; Office Action issued Nov. 9, 2011.

Baker Hughes Baker Oil Tools Remedial Systems Technical Unit QUIK Drill Composite Bridge Plug and Wireline Adapter Kit Product Family Nos. H40129 and H43848, Feb. 28, 2002, pp. 1-12.

Weatherford FracGuard Composite Plugs, 2004, 7 pages.

BJ Python Composite Bridge Plug, Product Information Sep. 20, 2001, 1 page.

Halliburton FAS Drill Squeeze Packers, Drillable Tools, 1999, 6 page.

Weatherford Completion Systems FracGuard Series Composite Frac Plug 2001, Brochure No. 432.00 & 433.00; 2 pages.

BioBalls MR, Soluble Ball Sealers, www.santrol.com, Applicant believes that the Bioballs were offered for sale prior to the filing date of applicant's application.

Nish, et al., U.S. Appl. No. 12/253,319, filed Oct. 17, 1908.

Nish, et al., U.S. Appl. No. 12/253,337, filed Oct. 17, 1908.

Nish, et al., U.S. Appl. No. 12/353,655, filed Jan. 14, 1909.

Vogel, et al. U.S. Appl. No. 12/549,652, filed Aug. 28, 2009.

Composite Plugs, Magnum Oil Tools International; 19 pages.

U.S. Appl. No. 13/176,107, filed Jul. 5, 2011; Randall Nish.

U.S. Appl. No. 12/253,337, filed Oct. 17, 2008; Randall W. Nish; office action dated May 2, 2013.

U.S. Appl. No. 13/176,107; filed Jul. 5, 2011; Nish; office action dated Sep. 11, 2013.

* cited by examiner

COMPOSITE DOWNHOLE TOOL WITH RATCHET LOCKING MECHANISM

RELATED APPLICATIONS

This is related to U.S. patent application Ser. Nos. 11/800,448 (U.S. Pat. No. 7,735,549); 12/253,319; 12/253,337; 12/353,655 (which claims priority to 61/089,302); and 12/549,652 (which claims priority to 61/230,345); which are hereby incorporated herein by reference in their entirety.

BACKGROUND

1. Field of the Invention

The present invention relates generally to bridge and fracture plugs used in oil and gas wells.

2. Related Art

Just prior to beginning "production," oil and gas wells are completed using a complex process involving explosive charges and high pressure fluids. Once drilling is complete, a well is lined with steel pipe backed with cement that bridges the gap between the pipe outer diameter and rock face. The steel/cement barrier is then perforated with explosive shaped charges. High pressure fluids and proppants (spherical sand or synthetic ceramic beads) are then pumped down the well, through the perforations and into the rock formation to prepare the rock for the flow of gas and oil into the casing and up the well. This fracturing process is repeated several times in a given well depending on numerous factors including the depth of the well, casing diameter, reservoir pressure, the number of oil or gas bearing layers, etc.

The number of layers to be perforated and fractured can be as few as one or more than thirty. As they prepare to "frac" (i.e. hydraulic fracturing) at each level, well technicians set a "temporary plug" in the bore of the steel casing pipe (just below where they will perforate) that will then allow them to pump "frac fluids" and sand down through the perforations and into the oil and gas bearing layers of rock. Use of the temporary plug prevents contaminating the already-fractured levels below. This process is repeated several times, as the frac operation moves up the well, until all desired zones have been perforated, fractured and the needed amount of proppant has been pumped into the rock. At each level, the temporary plugs are usually left in place, so that they can all be drilled out at the end of the process, in a single operation.

These "temporary plugs" have traditionally been made from cast iron. These cast iron plugs have a threaded center mandrel and a threaded locking ring set inside of a threaded push sleeve. When the plug is set, a setting sleeve pushes against the top of the push sleeve and compresses the stack of slips, cones and rubber elements. The rubber elements expand outward and inward and create a seal between the elements and mandrel and the elements and the inner diameter of the well casing. The lock ring engages the threads in the mandrel and the threads in the push sleeve to prevent backward (i.e. upward) movement once the force from the setting tool is released. This locking action keeps pressure on the elements which preserves the seal and keeps the slips locked to the inner diameter of the casing. This blocks fluid from getting to the lower layers of rock and creates the seal needed to perform hydraulic fracturing in the layers above the plug.

It has been proposed to make plugs from other materials, such as aluminum alloy, which can use a push sleeve, locking ring and threaded mandrel similar to that described above. It has also been proposed to make plugs from composite materials. Some composite plugs can use a push sleeve to retain a locking ring that bites into the composite mandrel directly to keep the elements compressed and the slips locked in place after the setting force is removed. Other composite plugs have a fixed top stop so that the upper structural stop does not translate axially like a push sleeve, but rather stays fixed in place. Once the slips are locked to the casing inner diameter and the elements are compressed, the mandrel appears to be free to slide up and down in the elements (or stroke) until the top stop or anvil contacts the upper or lower slips. The upward movement can be caused when pressure from the oil or gas below exceeds the pressure applied from above. The downward movement acts in the opposite manner. Some elements or packers have directional properties. For example, some elements or packers have a greater upper seal pressure than lower seal pressure. Allowing the mandrel to stroke can change the relative motion and change the directional properties of the seals.

Examples of such plugs include U.S. Pat. Nos. 3,306,366; 3,517,742; 4,708,202; 5,131,468; 5,224,540; 5,701,595; 6,167,963; 6,220,349; 6,354,372; 6,581,681; and US 2004-0036225 and 2005-0189103.

SUMMARY OF THE INVENTION

It has been recognized that it would be advantageous to develop a downhole tool or plug that can take advantage of the easier drill-out characteristics of a composite mandrel as well as resist stroking of the mandrel when set and/or changing the directional properties of the seal, elements or packers.

The invention provides a downhole tool or plug device disposable in a casing of an oil or gas well. The device has a mandrel with an element disposed thereon that is compressible and radially expandable to seal between the mandrel and the casing. A slip ring is disposed thereon and is radially expandable to engage the casing. A cone is adjacent the slip ring to radially displace the slip ring, and the element. The slip ring and the cone are pressable between an upper push sleeve assembly and a lower anvil on the mandrel. The upper push sleeve assembly includes a lock ring that has one or more interior teeth on an interior of the lock ring with an inclined surface inclined with respect to a longitudinal axis of the mandrel and facing towards the anvil, and a blunt surface essentially perpendicular to the longitudinal axis and facing away from the anvil. A mandrel sleeve is at least partially received within a recess in the mandrel and affixed with respect to the mandrel. The mandrel has one or more exterior teeth on an exterior of the mandrel sleeve with an inclined surface inclined with respect to the longitudinal axis of the mandrel and facing towards the upper push sleeve assembly, and a blunt surface essentially perpendicular to the longitudinal axis and facing towards the anvil. The one or more interior teeth of the lock ring are located longitudinally away from the one or more exterior teeth of the mandrel sleeve when unset, and the blunt surface of the one or more interior teeth of the lock ring engaging the blunt surface of the one or more exterior teeth of the mandrel sleeve when set.

In accordance with another aspect, the invention provides a downhole tool or plug device disposable in a casing of an oil or gas well. The device has a mandrel comprising a composite material and carrying an element that is compressible and radially expandable to seal between the mandrel and the casing, a slip ring that is radially expandable to engage the casing, a cone that is adjacent the slip ring to radially displace the slip ring, an upper push sleeve assembly, and a lower anvil affixed to the mandrel. The element, the slip ring and the cone are pressable between the upper push sleeve and the lower anvil during setting. At least one lock tooth is associated with the upper push sleeve. At least one tooth is on an exterior of the mandrel and is formed of a different material than the mandrel. The at least one lock tooth of the upper push sleeve engages the at least one tooth of the mandrel when set to lock the upper push sleeve with respect to the mandrel.

In accordance with another aspect, the invention provides a downhole tool or plug device disposable in a casing of an oil or gas well. The device includes a mandrel with a composite material. An element is carried by the mandrel and is axially displaceable along the mandrel during setting and is compressible and radially expandable to seal between the mandrel and the casing when set. At least one a slip ring is carried by the mandrel and is radially expandable during setting to engage the casing when set. At least one cone is carried by the mandrel and is adjacent the at least one slip ring and is axially displaceable during setting to radially displace the slip ring. A lower anvil is fixed with respect to the mandrel. An upper push sleeve assembly is carried by the mandrel with the element, the at least one slip ring and the at least one cone located between the upper push sleeve and the lower anvil. The upper push sleeve assembly is axially displaceable during setting to press the element, the at least one slip ring and the at least one cone between the upper push sleeve assembly and the lower anvil on the mandrel. A shallow annular recess is formed in the mandrel between the upper push sleeve assembly and the anvil when unset. A deeper annular groove is formed in the shallow annular recess of the mandrel at an end of the shallow annular recess. A mandrel sleeve is disposed in the shallow annular recess with an annular lip at an end thereof projecting inwardly into the deeper annular groove. A plurality of annular teeth is arrayed axially on the exterior of the mandrel sleeve. The upper push sleeve assembly includes a lock ring with a slot and is radially expandable and contractable. A plurality of annular interior teeth is arrayed axially on an interior of the lock ring. The plurality of interior teeth of the lock ring engage the plurality of external teeth of the mandrel sleeve when set. The upper push sleeve assembly includes a collar circumscribing the lock ring.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Definitions

The terms "upper" and "lower" are used herein with respect to the orientation of the plug in an upright, vertical orientation, even though the plug can be used in horizontal orientations or wells, where upper is still towards the upper end of the well and lower is still towards the lower end of the well.

The term "plurality of teeth" is used herein to refer to more than one tooth in an axial direction, and is intended to include screw threads with even a single continuous thread.

The terms "casing", "pipe" and "well" are used interchangeably herein.

The terms "slips" and "slip rings" are used interchangeably herein.

The terms "spool" and "mandrel" are used interchangeably herein.

The terms "downhole tool" and "plug" and "mandrel assembly" are used interchangeably herein.

Specification

As illustrated in FIGS. 1*a*-5*b*, a downhole tool or plug or mandrel assembly, indicated generally at 10, in an example implementation in accordance with the invention is shown for use in a casing 14 (FIG. 4*a*) or pipe of an oil or gas well. The plug 10 includes a ratcheting locking mechanism that can be used with a composite mandrel or spool to maintain the sealing forces needed to assure an adequate seal between the casing and the elements or packers of the plug. The ratchet mechanism includes one more teeth on a lock ring engaging one or more teeth on a mandrel during setting or in a set configuration, where the one or more teeth on the mandrel are of a different material than the mandrel. Thus, the mandrel teeth can be formed of a material that is stronger than the material of the mandrel itself. The one or more teeth of the mandrel can be provided with a mandrel sleeve having the teeth thereon disposed in an annular recess on the mandrel.

The plug 10 can be configured as one of various different type plugs, such as a bridge plug to restrict flow in either direction (up and down), a fracture ("frac") plug to restrict flow in one direction (typically down), or a soluble insert plug that begins as a bridge plug, but then transitions to a frac plug after a predetermined time or condition in the well. It will be appreciated that the plug can be configured as other types of plugs as well. Various aspects of such plugs are shown in U.S. patent application Ser. Nos. 11/800,448 (U.S. Pat. No. 7,735,549); 12/253,319; 12/253,337; 12/549,652; 12/353,655 (61/089,302); and 12/549,652 (61/230,345); which are herein incorporated by reference.

Figure 4A:
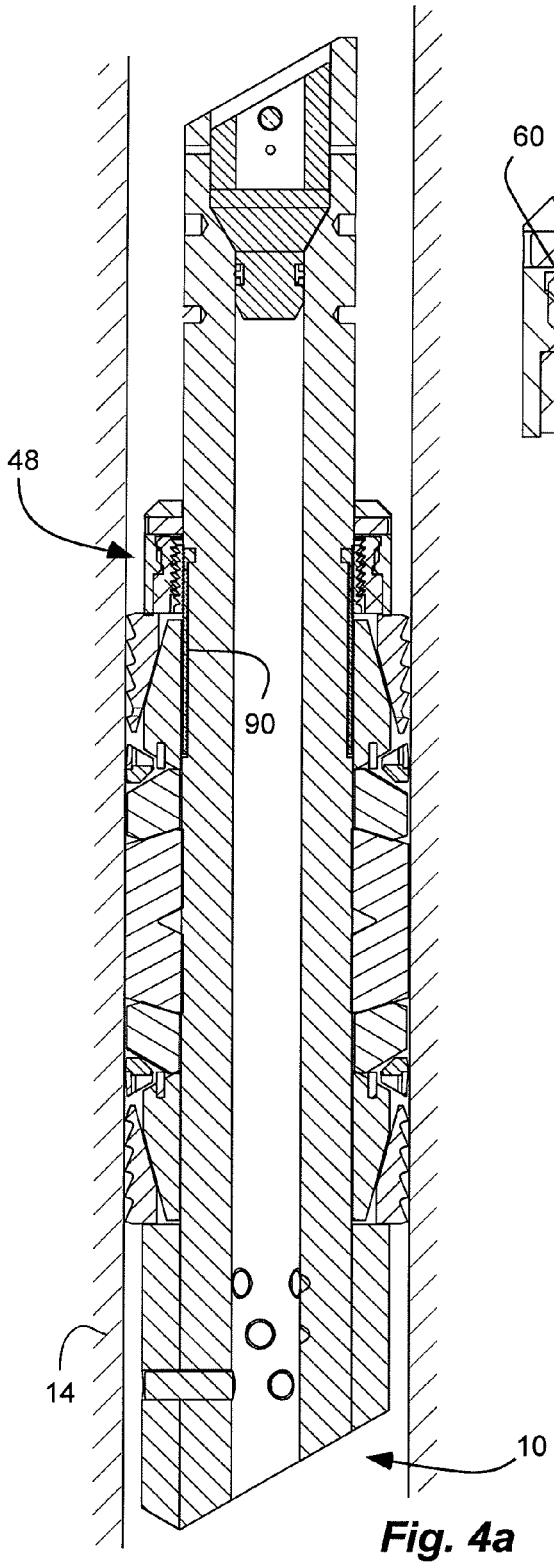
FIG. 4*a* is a schematic view of the downhole tool of FIG. 1*a* shown in a set configuration within a wellbore.
Figure 4B:
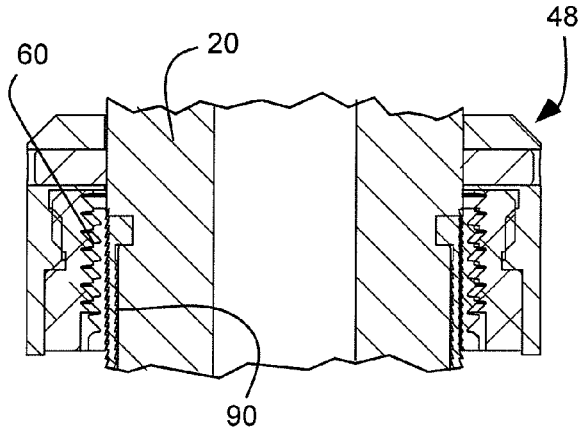
FIG. 4*b* is a detailed schematic view of the downhole tool of FIG. 1*a* shown in the set configuration in the wellbore with teeth of a lock ring engaging the teeth of a mandrel sleeve.
Figure 5A:
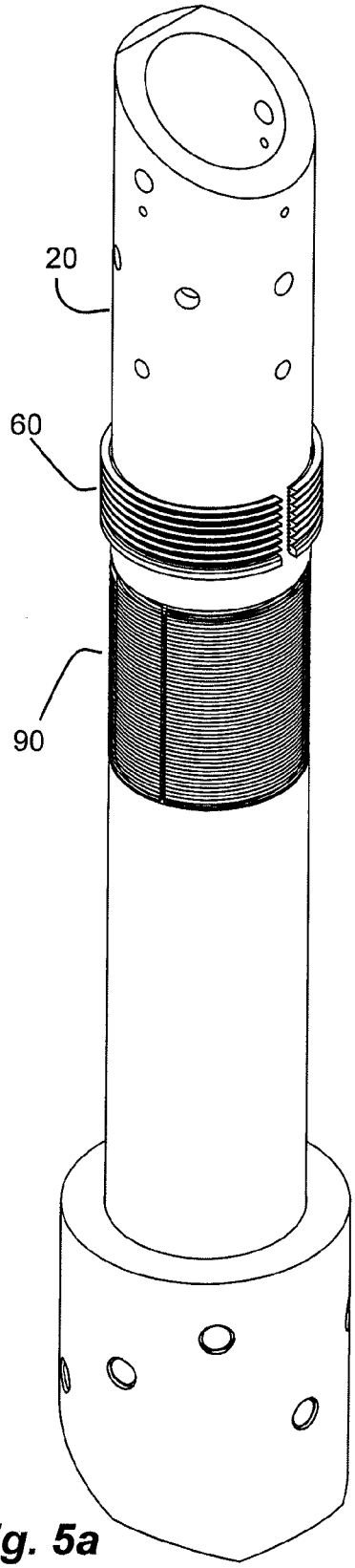
FIG. 5*a* is a perspective view of a mandrel sleeve and a lock ring on a mandrel of the downhole tool of FIG. 1*a*.
Figure 5B:
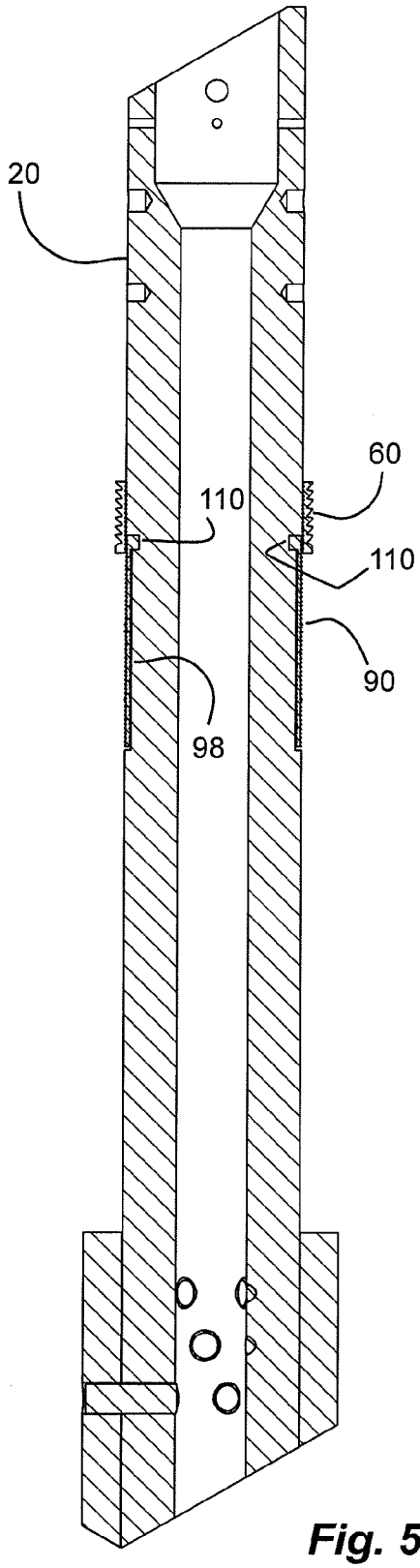
FIG. 5*b* is a cross-sectional side view of a mandrel sleeve and a lock ring on a mandrel of the downhole tool of FIG. 1*a*.

The plug 10 includes a center mandrel or mandrel 20 that can be made of, or that can include, a composite material, such as a fiber in a resin matrix. The mandrel 20 holds or carries various other components which allow it to be coupled to a setting tool that is lowered into the casing of the well, and which allow it to engage and seal with the casing. Thus, the mandrel has an outer diameter less than an inner diameter of the casing of the well. The mandrel can have a center bore 24 which can allow for the flow from the reservoir below when the plug is configured as a frac plug. In addition, the mandrel can have a seat 28 disposed in the bore 24. The seat can be formed by an internal annular flange in the bore. The upper portion of the bore, at a top of the plug, and the seat can be configured to receive various different components to determine the type of plug and operating characteristics. For example, a fixed bridge plug can be fixed in the upper portion of the bore and can abut to the seat to seal the bore and form the plug as a bridge plug, as shown in FIG. 4*a*. As another example, a ball or the like can be movably retained in the upper portion of the bore and movable against and away from the seat, forming a one way check valve, to configure the plug as a frac plug.

One or more packers or elements 32 are disposed on and carried by the mandrel. The elements 32 can include one or more compressible rings. Under longitudinal or axial pressure or force, the elements compress longitudinally and expand radially (outward to the casing of the well and inwardly to the mandrel) to fill a space between the mandrel and the casing of the well, thus forming a seal. In addition, one or more backing rings 36, such as upper and lower backing rings, can be disposed at opposite sides of the elements and carried by the mandrel to resist longitudinal or axial extrusion of the elements under pressure. One or more slips or slip rings 40 (such as upper and lower slips or slip rings) are disposed at opposite sides of the elements and carried by the mandrel. The slips 40 can have teeth on the exterior surface, and can expand or fracture radially to engage and grip the casing of the well. One or more cones 44 (such as upper and lower cones) can be carried by the mandrel and associated with each of the one or more slips adjacent the slips to radially displace and fracture the slip rings as a cone and slip ring are pressed together.

Above and below these components are an upper push sleeve assembly 48 and a lower anvil or mule shoe 52 which are structural features designed to resist the hydrostatic, hydrodynamic and compression loads acting on the plug and the elements and their related hardware. Thus, the setting tool presses down on the push sleeve assembly 48, which in turn presses the components against the anvil 52, causing the elements to expand radially and seal, and causing the slips to fracture, slide outward on the cones, and radially bite into the casing to secure the plug in place. As indicated above, components installed in the upper end of the mandrel determine whether the plug will act as a "frac" or "bridge" plug or some other type of plug. The plug can be field configurable, such as by a tool hand "on site" at the well, as a bridge, frac, and/or soluble insert plug. The plug can be shipped direct to the field as described above, with an assembly of elements to seal the casing; backing rings, cones and slips on the mandrel. These components are crushed, pressed or compressed as a setting sleeve acts upon the push sleeve assembly. The elements are forced out to seal the steel casing's inner diameter and the compression load needed to create and maintain the seal is maintained by the slips which lock to the casing's inner diameter. The compression loads acting on the slips are about 25,000 lbs, and must be maintained for weeks or even months at a time.

As described above, the mandrel 20 can be formed of, or can include, a composite material. The mandrel 20 can have a substantial diameter, except for annular recesses as described below, and except for the anvil 52, which can formed with the mandrel resulting in a larger lower diameter, or affixed thereto such as with pins. Similarly, the cones 44 can be formed of, or can include, a composite material. The slips can be formed of metal, such as cast iron. The cast iron material of the slips assists in securing the plug in the well casing, while the composite material of the mandrel and the cones eases the drill out procedure. The plug or mandrel can have a longitudinal axis 56.

The push sleeve assembly 48 has a lock ring 60 and a pair of push sleeves, including inner and outer push sleeves 64 and 68. The lock ring 60 and inner push sleeve 64 can form a pair of locking rings to assist in maintaining the compression force on the elements and slip rings. The inner push sleeve can be a solid annular ring circumscribing the lock ring. The lock ring 60 can have a longitudinal or axial slot splitting the lock ring, similar to a c-ring. The lock ring 60 can circumscribe essentially the entire mandrel except for the slot in one aspect, or a majority of the mandrel in another aspect. In addition, the lock ring can be flexible and resilient, and can be formed of metal, such as ductile iron. Thus, the lock ring can expand and contract radially. Furthermore, the lock ring can have an inner diameter slightly less than an outer diameter of the mandrel. Thus, the lock ring can form an interference fit along the mandrel, but contract, as described below. The inner push sleeve can circumscribe the lock ring and retain the lock ring on the mandrel.

Figure 1A:
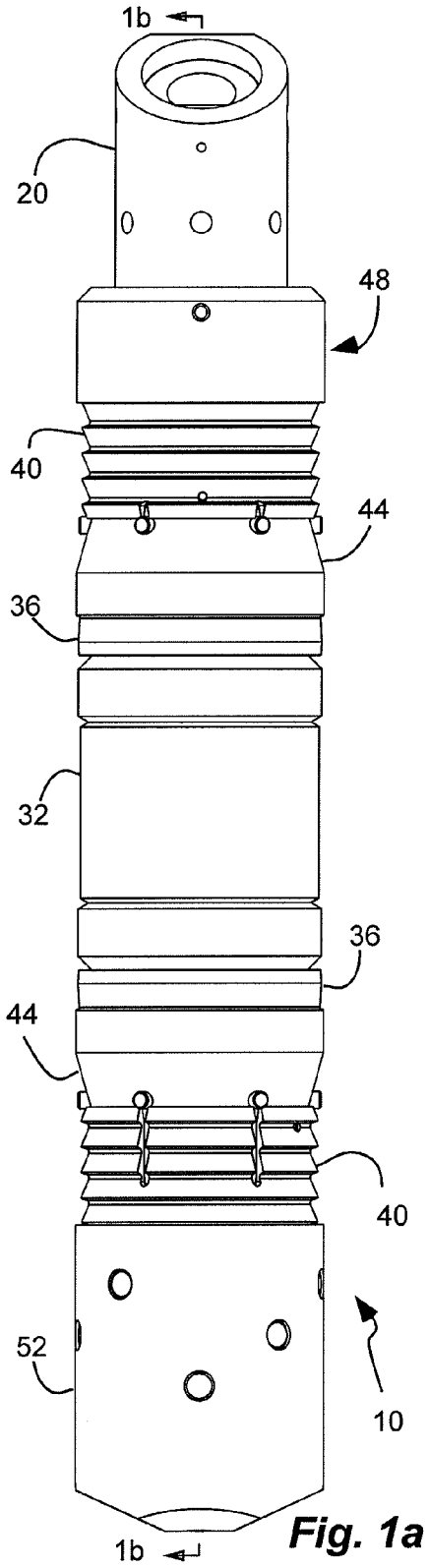
FIG. 1*a* is a side view of a composite downhole tool in accordance with an embodiment of the present invention shown in an unset configuration.
Figure 1B:
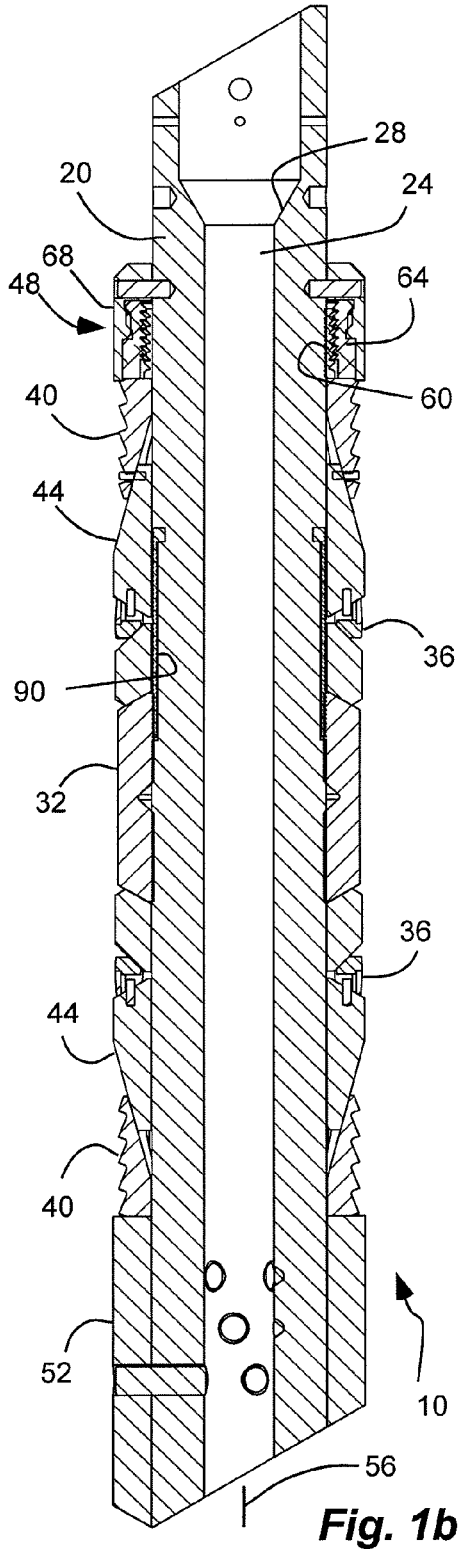
FIG. 1*b* is a cross-sectional side view of the downhole tool of FIG. 1*a* taken along line 1*b*-1*b* in FIG. 1*a;*
Figure 1C:
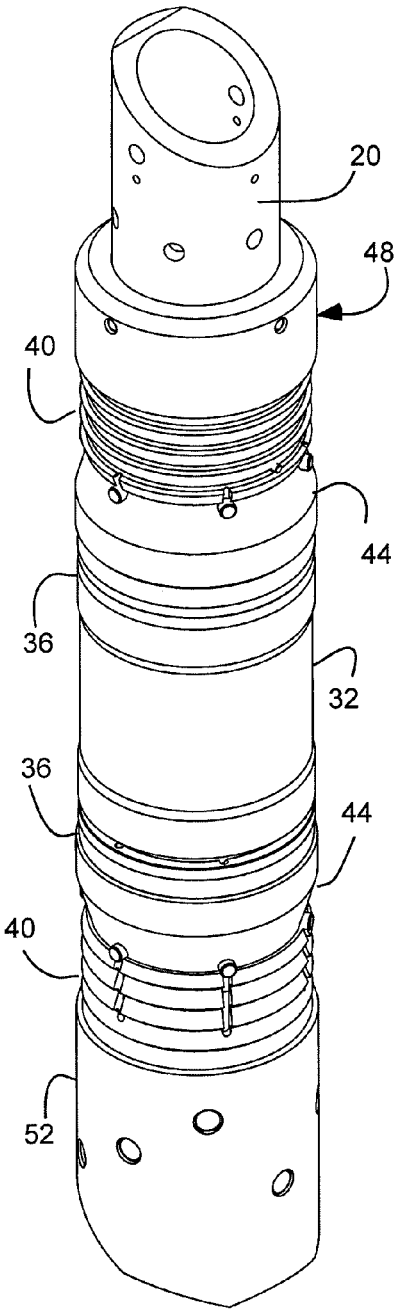
FIG. 1*c* is a side perspective view of the downhole tool of FIG. 1*a;*
Figure 1D:
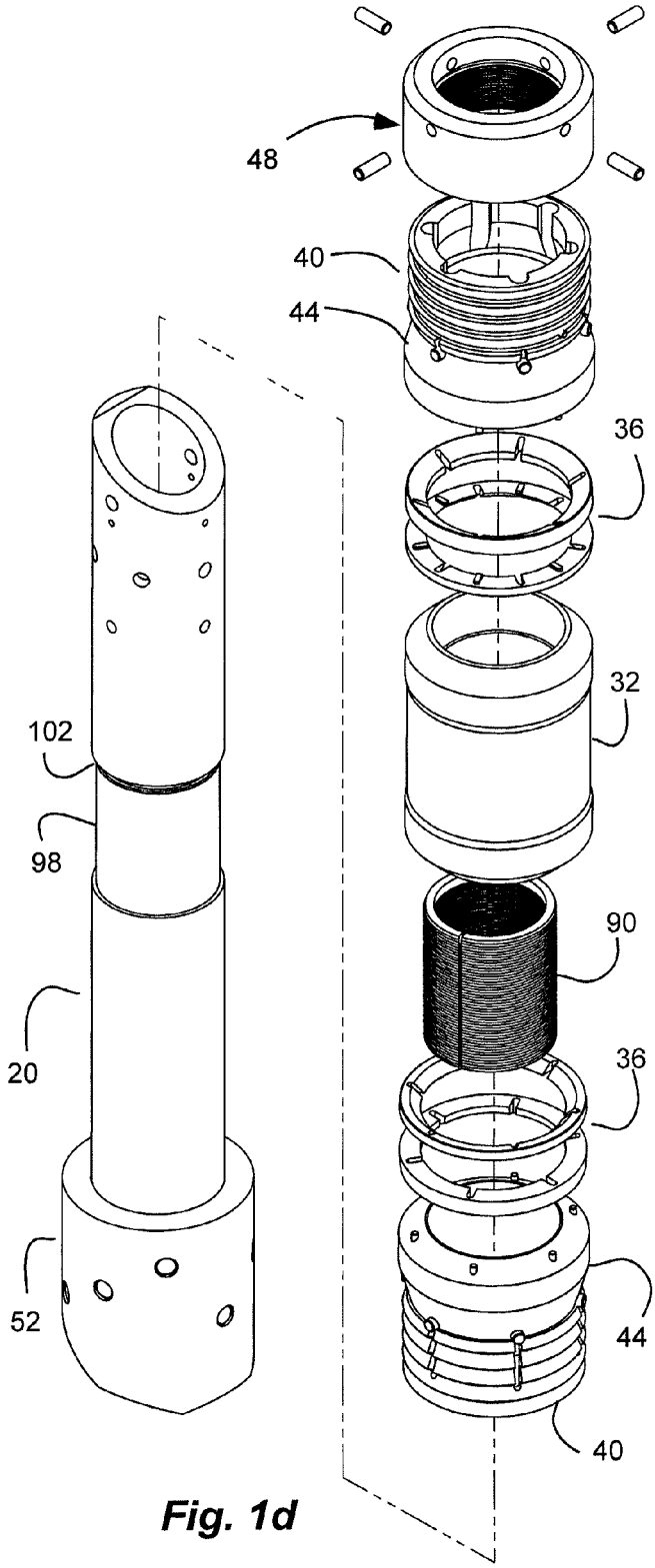
FIG. 1*d* is an exploded perspective view of the downhole tool of FIG. 1*a;*
Figure 2A:
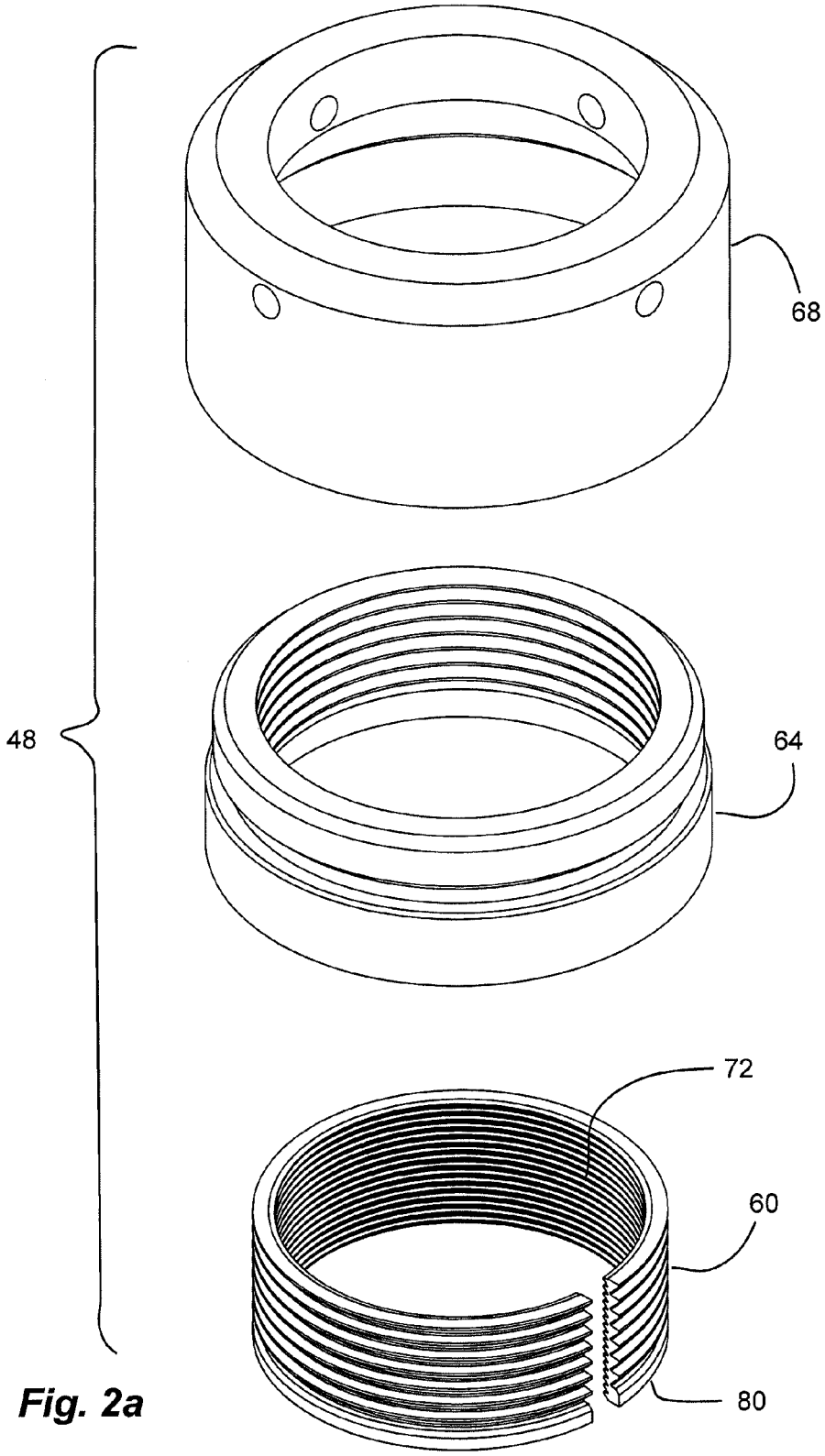
FIG. 2*a* is an exploded perspective view of a push sleeve assembly of the downhole tool of FIG. 1*a;*
Figure 2B:
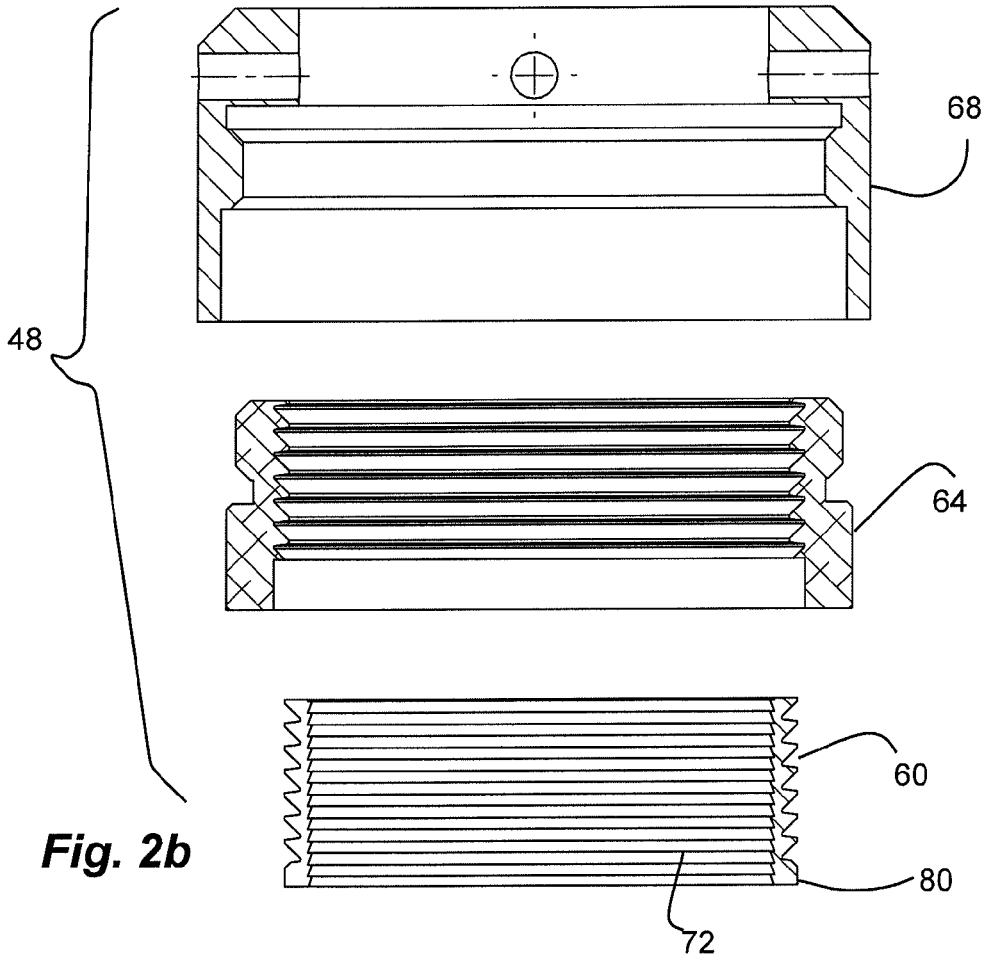
FIG. 2*b* is an exploded cross-sectional side view of the push sleeve assembly of FIG. 2*a;*
Figure 3A:
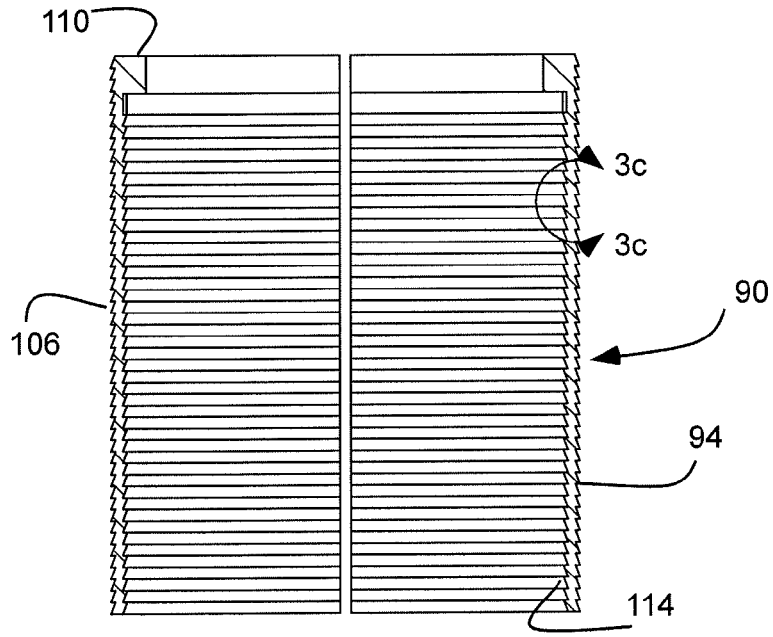
FIG. 3*a* is a cross-sectional side view of a mandrel sleeve of the downhole tool of FIG. 1*a;*
Figure 3B:
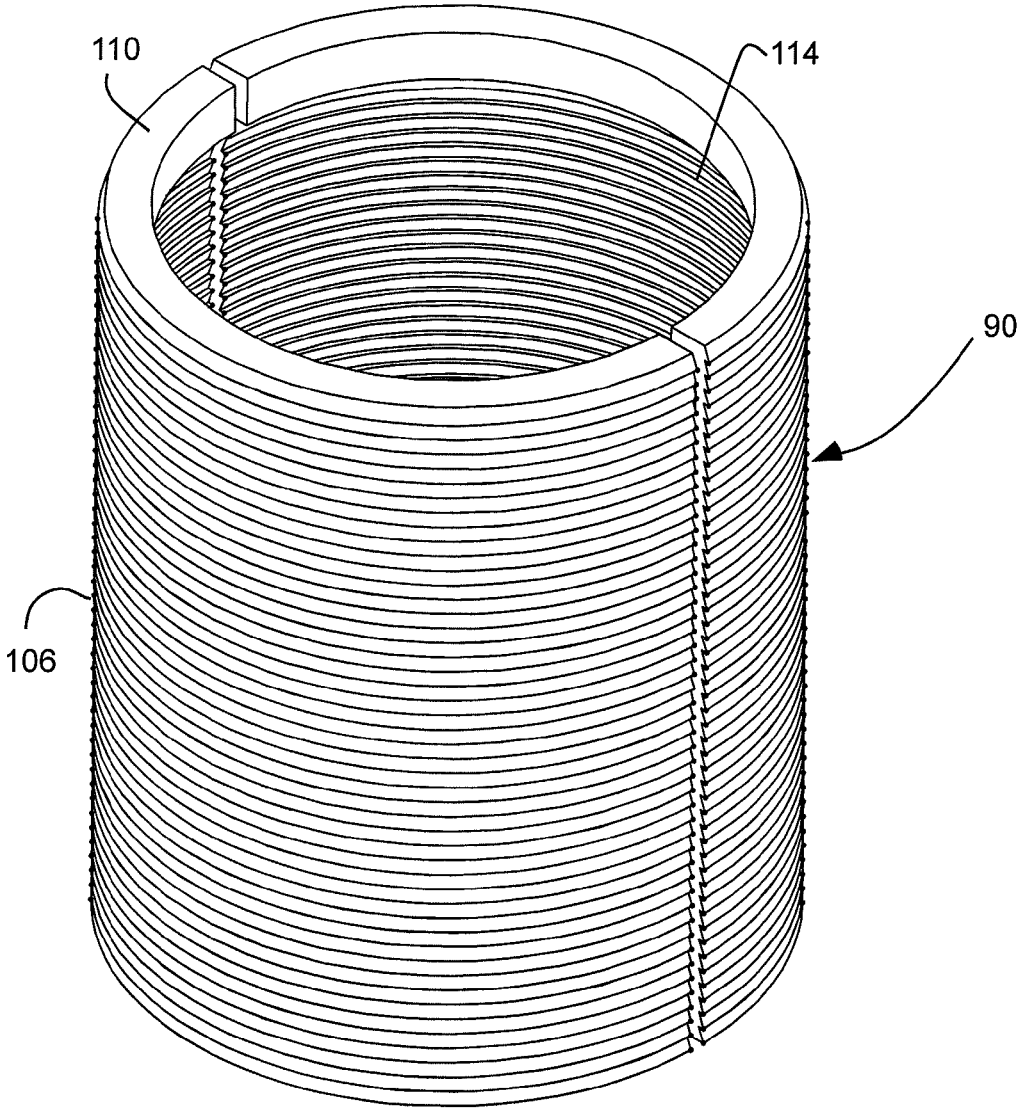
FIG. 3*b* is a perspective view of the mandrel sleeve of FIG. 3*a;*
Figure 3C:
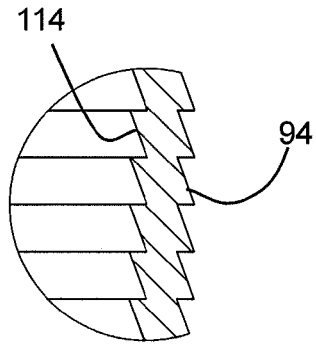
FIG. 3*c* is a detailed view of the mandrel sleeve of FIG. 3*a* taken along line 3*c*-3*c* of FIG. 3*a;*

The lock ring 60 has at least one internal tooth on its interior or inner surface that can engage the mandrel, as described below. In one aspect, the lock ring 60 has a plurality of internal teeth or threads 72 (FIG. 2*b*). The plurality of internal teeth can be axially arrayed. The interior tooth, teeth or thread can have an inclined surface inclined (such as at 45 degrees) with respect to a longitudinal axis of the mandrel and facing towards the anvil, and a blunt surface essentially perpendicular (such as 0-10 degrees) to the longitudinal axis and facing away from the anvil. Thus, the interior of the lock ring can have a buttress thread. The lock ring and the internal teeth or threads can be substantially annular and can substantially circumscribe the mandrel, or can circumscribe a majority of the mandrel to increase the contact or engagement surface area. Similarly, the outer or exterior surface of the lock ring can also be threaded so match with a mating thread on the interior of the inner push sleeve 64. Thus, the lock ring and inner push sleeve can be threaded together by matching buttress threads. A shoulder 80 can be formed on the lower or outer end of the lock ring. The shoulder 80 can be wider or longer than the thread in the axial direction so that the lock ring can only be inserted into the inner push sleeve in one direction to assist in orienting the internal tooth, teeth or thread of the lock ring in the correct orientation during assembly. The inner push sleeve 64 can be formed of metal, such as aluminum. The inner push sleeve can be threaded into connection with the outer push sleeve 68. The outer push sleeve can be formed of composite material and can completely circumscribe and cover the inner push sleeve and lock ring. During setting the inner push sleeve 64 can abut directly to the slip 40 or upper slip.

The mandrel 20 can have or can carry a mandrel sleeve 90 with at least one exterior tooth on its exterior. In one aspect, the mandrel sleeve has a plurality of exterior teeth or threads 94. The plurality of exterior teeth can be axially arrayed. The external tooth, teeth or threads of the mandrel sleeve can mate or match the internal tooth, teeth or threads of the lock ring. The exterior tooth, teeth or threads can have an inclined surface inclined (such as at 45 degrees) with respect to the longitudinal axis of the mandrel and facing towards the upper push sleeve assembly, and a blunt surface essentially perpendicular (such as 0-10 degrees) to the longitudinal axis and facing towards the anvil. The one or more interior teeth 72 of the lock ring 60 can be located longitudinally or axially away from the one or more exterior teeth 94 of the mandrel sleeve 90 when unset; but with the blunt surface of the one or more interior teeth of the lock ring engaging the blunt surface of the one or more exterior teeth of the mandrel sleeve when set. Thus, as indicated above, the internal teeth of the lock ring can slid down the mandrel with an interference fit during setting, but engage the external teeth of the mandrel sleeve when set, to resist axial movement of the lock ring back up the mandrel and keep the elements and other components compressed on the mandrel. The lock ring locking to the mandrel sleeve, and thus the mandrel, reduces or eliminates stroking or movement of the mandrel inside the elements to maintain seal characteristics particularly with respect to elements or packers with directional properties. It is believed that the lock ring and inner push sleeve, or pair of locking rings, can be annular and can thread together, without mating conical surfaces designed to squeeze or compress the lock ring, while providing sufficient engagement.

The mandrel sleeve 90 and/or tooth, teeth or thread can be disposed in a recess of the mandrel. In one aspect, the recess can include a shallow annular recess 98 and a deeper annular groove 102 at one axial end of the shallow recess, for example at the top as shown. The shallow recess and annular groove can be formed by changes in diameter along the length of the mandrel. The mandrel sleeve can be a cylinder 106 that fits in the shallow annular recess. The mandrel sleeve and the exterior teeth can be substantially annular and can substantially circumscribe the mandrel, or can circumscribe a majority of the mandrel to increase the contact or engagement surface area. The sleeve or cylinder can include an annual lip, thrust ring or shoulder 110 at one end of the cylinder that projects. The annular lip can fit in the deeper annular groove. The mandrel sleeve 90 or tooth, teeth or thread can be formed of a material that is different from the material of the mandrel. For example, the mandrel sleeve can be metal, such as cast iron, while the mandrel can include a composite. The mandrel sleeve can provide a harder material for the lock ring to engage. The recess transfers the force from the lock ring, through the mandrel sleeve to the mandrel. The deeper groove and annular lip, thrust ring or shoulder creates a greater surface area to transfer force to the mandrel, and reduce pressure. Locating the deeper groove and annular lip, thrust ring or shoulder at the top of the annular recess and sleeve, respectively, creates compression forces, rather than tension forces. Alternatively, the deeper groove and annular lip can be disposed at the bottom of the annular recess and sleeve, respectively. The mandrel sleeve 90 can be split axially or longitudinally into at least two partial circular segments to facilitate assembly. In addition, the mandrel sleeve can include interior teeth 114 in the opposite direction from the exterior teeth to further grip and transfer force to the mandrel. The outer diameter or dimension of the sleeve defined by exterior teeth 94 of the mandrel sleeve 90 can be flush or slightly recessed with respect to the outer diameter of the mandrel adjacent to the recess. Thus, the elements can slide along the mandrel without undue influence or damage by the teeth. The mandrel sleeve can be approximately 3 inches long to accommodate different plug configurations for different casing diameters.

The inner and outer push sleeves 64 and 68 can be threaded together with external screw threads on the inner push sleeve and mating interior screw threads on the outer push sleeve. Alternatively, inner push sleeve can have on outer conical surface narrowing away from the slips or slip ring because the force applied by the slips or slip ring to the inner push sleeve is applied by the threads or threaded coupling to the lock ring. The outer push sleeve can have a mating or matching interior conical surface. The outer push sleeve 68 can be formed of a composite, such as fiberglass. The inner push sleeve 64 can be placed immediately adjacent the upper slip ring (or the upper cone) such that the upper slip ring (or the upper cone) bear directly against the base of the inner push sleeve. The inner push sleeve takes the considerable load from the slips into the lock ring and on to the mandrel sleeve and thus the mandrel. Thus, the fiberglass portion of the push sleeve or the outer push sleeve can become (after setting) a cosmetic feature only.

During setting, a setting tool can pull up on the mandrel while holding (or pressing down) on the upper push sleeve assembly. Thus, the element(s), slips, cones, etc. are pressed between the upper push sleeve assembly and the anvil. In addition, the upper push sleeve assembly, and other of the components, displace or translate axially towards the anvil. As described above, the lock ring and interior teeth thereof can slide down the mandrel until the lock ring reaches the mandrel sleeve and exterior teeth thereof. The lock ring can contract about the mandrel sleeve such that the interior teeth engage the exterior teeth. The interior teeth can ratchet down the exterior teeth until the tool or plug is set. The lock ring can expand to allow the interior teeth to pass over exterior teeth with the inclined surfaces of both interior and exterior teeth forcing the lock ring to expand. It will be appreciated that movement of the lock ring in the opposite direction (upward) is resisted by the blunt surfaces of both the interior and exterior teeth abutting one another, and with the lock ring contracted about the mandrel sleeve. Force against the inner push sleeve is transferred to the lock ring, through the interior teeth of the lock ring to the exterior teeth of the mandrel sleeve, and from the mandrel sleeve to the mandrel by the interior teeth of the mandrel sleeve and/or the shoulder. Thus, teeth of the lock ring do not need to directly engage the mandrel, and the lock ring and inner push sleeve do not need to be configured, such as with wedge or conical mating surfaces, to squeeze the interior teeth of the lock ring into direct engagement with the mandrel.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A downhole tool device disposable in a casing of an oil or gas well, comprising:

a) a mandrel with an element disposed thereon compressible and radially expandable to seal between the mandrel and the casing, and with a slip ring disposed thereon radially expandable to engage the casing, and with a cone adjacent the slip ring to radially displace the slip ring, and the element, the slip ring and the cone being pressable between an upper push sleeve assembly and a lower anvil on the mandrel;

b) the upper push sleeve assembly including a lock ring having one or more interior teeth on an interior of the lock ring with an inclined surface inclined with respect to a longitudinal axis of the mandrel and facing towards the anvil, and a blunt surface essentially perpendicular to the longitudinal axis and facing away from the anvil;

c) a recess formed in the mandrel and comprising a shallow annular recess in the mandrel and a deeper annular groove at one end of the shallow annular recess;

d) a mandrel sleeve at least partially received within the recess in the mandrel and affixed with respect to the mandrel, and having one or more exterior teeth on an exterior of the mandrel sleeve with an inclined surface inclined with respect to the longitudinal axis of the mandrel and facing towards the upper push sleeve assembly, and a blunt surface essentially perpendicular to the longitudinal axis and facing towards the anvil, and having one or more interior teeth on an interior of the mandrel sleeve that grip the mandrel;

e) the mandrel sleeve comprising a cylinder disposed in the shallow annular recess of the mandrel and an interior projecting annular lip projecting into the deeper annular groove; and d) the one or more interior teeth of the lock ring being located longitudinally away from the one or more exterior teeth of the mandrel sleeve when unset, and the blunt surface of the one or more interior teeth of the lock ring engaging the blunt surface of the one or more exterior teeth of the mandrel sleeve when set.

2. A device in accordance with claim 1, wherein the mandrel sleeve is longitudinally split into at least two partial segments.

3. A device in accordance with claim 1, wherein the recess in the mandrel comprises: an annular shallow recess and an annular deep groove disposed at an end of the shallow recess; and wherein the mandrel sleeve comprises:

a cylinder disposed in the annular shallow recess of the mandrel; and an annular lip at an end of the cylinder projecting inwardly into the annular deep groove of the mandrel; and the cylinder and annular lip being longitudinally split into at least two partial segments.

4. A device in accordance with claim 1, wherein both the mandrel sleeve and the lock ring circumscribe a majority of the mandrel; and wherein the one or more interior teeth of the lock ring and the one or more exterior teeth of the mandrel sleeve circumscribe a majority of the mandrel.

5. A device in accordance with claim 1, wherein the one or more interior teeth of the lock ring and the one or more exterior teeth of the mandrel sleeve are substantially annular.

6. A device in accordance with claim 1, wherein the mandrel includes a composite material; and wherein the mandrel sleeve and the lock ring are formed of metal.

7. A device in accordance with claim 1, wherein an outer dimension of the mandrel sleeve defined by the one or more teeth is flush or recessed with a diameter of the mandrel adjacent the recess in the mandrel.

8. A device in accordance with claim 1, wherein the lock ring has a slot and can expand to fit the mandrel and can contract to engage the mandrel sleeve; and wherein the push sleeve assembly further includes a solid annular ring circumscribing the lock ring.

9. A downhole tool device disposable in a casing of an oil or gas well, comprising:

a) a mandrel comprising a composite material and carrying an element compressible and radially expandable to seal between the mandrel and the casing, a slip ring radially expandable to engage the casing, a cone adjacent the slip ring to radially displace the slip ring, and an upper push sleeve assembly, and having a lower anvil affixed to the mandrel, with the element, the slip ring and the cone being pressable between the upper push sleeve and the lower anvil during setting;

b) at least one lock tooth associated with the upper push sleeve;

c) at least one tooth on an exterior of the mandrel formed of a different material than the mandrel; and d) the at least one lock tooth of the upper push sleeve engaging the at least one tooth of the mandrel when set to lock the upper push sleeve with respect to the mandrel;

e) a recess formed in the mandrel and comprising a shallow annular recess in the mandrel and a deeper annular groove at one end of the shallow annular recess;

f) a mandrel sleeve at least partially received within the recess in the mandrel and affixed with respect to the mandrel, the mandrel sleeve having one or more interior teeth on an interior of the mandrel sleeve that grip the mandrel;

g) a plurality of exterior teeth axially arrayed on an exterior of the mandrel sleeve;

h) a lock ring associated with the upper push sleeve and axially displaceable during setting from a position away from the mandrel sleeve to a position towards the mandrel sleeve when set;

i) a plurality of interior teeth on an interior of the lock ring which engage the plurality of exterior teeth of the mandrel sleeve when set;

j) the mandrel sleeve comprising a cylinder disposed in the shallow annular recess of the mandrel and an interior projecting annular lip projecting into the deeper annular groove; and k) the cylinder and annular lip being longitudinally split into at least two partial segments.

10. A device in accordance with claim 9, wherein both the mandrel sleeve and the lock ring circumscribe a majority of the mandrel; and wherein the plurality of interior teeth of the lock ring and the plurality of exterior teeth of the mandrel sleeve circumscribe a majority of the mandrel.

11. A device in accordance with claim 9, wherein the plurality of interior teeth of the lock ring and the plurality of exterior teeth of the mandrel sleeve are substantially annular.

12. A device in accordance with claim 9, wherein an outer dimension of the mandrel sleeve defined by the plurality of exterior teeth is flush or recessed with a diameter of the mandrel adjacent the recess in the mandrel.

13. A device in accordance with claim 9, wherein the lock ring has a slot and can expand to fit the mandrel and can contract to engage the mandrel sleeve; and wherein the push sleeve assembly further includes a solid annular ring circumscribing the lock ring.

14. A downhole tool device disposable in a casing of an oil or gas well, comprising:

a) a mandrel including a composite material;

b) an element carried by the mandrel and axially displaceable along the mandrel during setting and compressible and radially expandable to seal between the mandrel and the casing when set;

c) at least one a slip ring carried by the mandrel and radially expandable during setting to engage the casing when set;

d) at least one cone carried by the mandrel and adjacent the at least one slip ring and axially displaceable during setting to radially displace the slip ring;

e) a lower anvil fixed with respect to the mandrel;

f) an upper push sleeve assembly carried by the mandrel with the element, the at least one slip ring and the at least one cone located between the upper push sleeve and the lower anvil, the upper push sleeve assembly being axially displaceable during setting to press the element, the at least one slip ring and the at least one cone between the upper push sleeve assembly and the lower anvil on the mandrel;

g) a shallow annular recess formed in the mandrel between the upper push sleeve assembly and the anvil when unset;

h) a deeper annular groove formed in the shallow annular recess of the mandrel at an end of the shallow annular recess;

i) a mandrel sleeve disposed in the shallow annular recess with an annular lip at an end thereof projecting inwardly into the deeper annular groove, the mandrel sleeve having one or more interior teeth on an interior of the mandrel sleeve that grip the mandrel;

j) a plurality of annular teeth arrayed axially on the exterior of the mandrel sleeve;

k) the upper push sleeve assembly including a lock ring having a slot and being radially expandable and contractable;

l) a plurality of annular interior teeth arrayed axially on an interior of the lock ring, the plurality of interior teeth of the lock ring engage the plurality of external teeth of the mandrel sleeve when set; and m) the upper push sleeve assembly including a collar circumscribing the lock ring.

15. A device in accordance with claim 14, wherein the plurality of interior teeth of the lock ring have an inclined surface inclined with respect to a longitudinal axis of the mandrel and facing towards the anvil, and a blunt surface essentially perpendicular to the longitudinal axis and facing away from the anvil; and the plurality of exterior teeth of the mandrel sleeve have an inclined surface inclined with respect to the longitudinal axis of the mandrel and facing towards the upper push sleeve assembly, and a blunt surface essentially perpendicular to the longitudinal axis and facing towards the anvil; and the plurality of interior teeth of the lock ring being located longitudinally away from the plurality of exterior teeth of the mandrel sleeve when unset, and the blunt surface of the plurality of internal teeth of the lock ring engaging the blunt surface of the plurality of external teeth of the mandrel sleeve when set.

* * * * *